US009935371B2

(12) United States Patent
Jervis et al.

(10) Patent No.: US 9,935,371 B2
(45) Date of Patent: Apr. 3, 2018

(54) ANTENNAS

(71) Applicant: HEWLETT PACKARD ENTERPRISE DEVELOPMENT LP, Houston, TX (US)

(72) Inventors: James W. Jervis, Sunnyvale, CA (US); Fanfan He, Sunnyvale, CA (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 71 days.

(21) Appl. No.: 15/142,648

(22) Filed: Apr. 29, 2016

(65) Prior Publication Data

US 2017/0317416 A1 Nov. 2, 2017

(51) Int. Cl.

| | |
|---|---|
| ***H01Q 1/38*** | (2006.01) |
| ***H01Q 9/20*** | (2006.01) |
| ***H01Q 5/40*** | (2015.01) |
| ***H01Q 1/50*** | (2006.01) |

(52) U.S. Cl.
CPC ..... *H01Q 5/40* (2015.01); *H01Q 1/50* (2013.01); *H01Q 9/20* (2013.01)

(58) Field of Classification Search
CPC .. H01Q 19/005; H01Q 9/0407; H01Q 9/0421; H01Q 9/0442; H01Q 1/38; H01Q 21/00; H01Q 5/50; H01Q 9/20
See application file for complete search history.

(56) References Cited

U.S. PATENT DOCUMENTS

| | | | | |
|---|---|---|---|---|
| 3,560,978 | A * | 2/1971 | Himmel et al. | G01S 1/02 342/399 |
| 4,479,130 | A * | 10/1984 | Snyder | H01Q 9/16 343/802 |
| 6,337,667 | B1 | 1/2002 | Ayala et al. | |
| 6,765,536 | B2 | 7/2004 | Phillips et al. | |
| 7,224,313 | B2 | 5/2007 | McKinzie et al. | |
| 7,696,928 | B2 | 4/2010 | Rowell | |
| 7,830,320 | B2 | 11/2010 | Shamblin et al. | |
| 8,988,298 | B1 * | 3/2015 | Akhoondzadehasl | H01Q 21/00 343/700 MS |
| 2002/0149527 | A1 * | 10/2002 | Wen | H01Q 1/38 343/727 |
| 2005/0153756 | A1 * | 7/2005 | Sato | H01Q 1/243 455/575.7 |
| 2016/0064808 | A1 | 3/2016 | Khidre et al. | |

OTHER PUBLICATIONS

Archana Agrawal and Ankit Jain, "Effect of Directly Coupled Parasitic Patch on Floral Shaped Patch Antenna," Jul.-Aug. 2012, pp. 954-957, IJERA, vol. 2, Issue 4.

* cited by examiner

*Primary Examiner* — Tho G Phan
(74) *Attorney, Agent, or Firm* — Hewlett Packard Enterprise Patent Department

(57) ABSTRACT

An example method of designing a multi-band antenna includes specifying a first portion of the multi-band antenna in a tangible medium, where the first portion corresponds to an existing design of a single-band monopole antenna for operating in a first frequency band, and specifying in the tangible medium a second portion of the multi-band antenna that is added to the first portion, where the second portion includes a dipole parasitic resonator that is resonant in a second frequency band.

15 Claims, 10 Drawing Sheets

ANTENNAS

BACKGROUND

Antennas may transmit information by converting electric power into electromagnetic waves, and may receive information by converting power from electromagnetic waves into an electrical signal. For example, charge carriers may move through an antenna according to an input electrical signal and as a result the antenna may radiate electromagnetic waves corresponding to the input electrical signal, or charge carriers may move through the antenna according to received electromagnetic waves and thereby may generate an electrical signal corresponding to the received electromagnetic waves to be output from the antenna.

DETAILED DESCRIPTION

Disclosed herein are examples of antennas, processes of designing antennas, and processes of manufacturing antennas.

Figure 1:
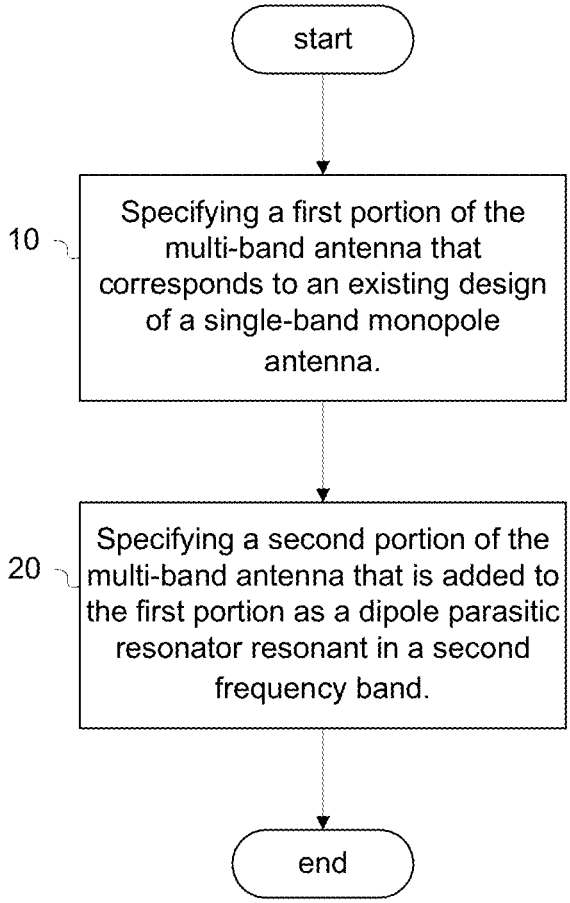
FIG. 1 is a process flow diagram illustrating an example process.

FIG. 1 illustrates an example process of designing a multi-band antenna. In process block 10, a first portion of the multi-band antenna is specified based on an existing design of a single-band monopole antenna. The existing design of the single-band monopole antenna may describe an antenna that is for operating in a first frequency band. For example, the first portion of the multi-band antenna that is be specified in process block 10 may correspond to the monopole antenna 110 illustrated in FIG. 2A.

Specifying the first portion may include any process that instantiates a design of the first portion in a concrete form, such as, for example, drawing the first portion, preparing a computer molding that includes the first portion, describing dimensions of the first portion, creating a prototype that includes the first portion, or the like. Specifying the first portion may also include selecting an already-existing concrete form that instantiates a given design (for example, an existing computer-aided-drafting (CAD) file), and proceeding to use the selected concrete form as part of a process of designing a multi-band antenna.

In process block 20, a second portion of the multi-band antenna is specified. The second portion is specified in such a manner that it is added to the first portion as a dipole parasitic resonator. The second portion may resonate in a second frequency band, which is different from the first frequency band. For example, the second portion of the multi-band antenna that is be specified in process block 20 may correspond to the dipole parasitic resonator 120 illustrated in FIG. 2B. The second portion may be added to the first portion in the manner illustrated in FIGS. 3 and 4, which show an example of how the dipole parasitic resonator 120 may be connected to the monopole antenna 110.

Specifying the second portion may include any process that instantiates a design of the second portion in the same concrete form that instantiates the first portion, such that the instantiation of the second portion is added to the instantiation of the first portion as a dipole parasitic resonator. For example, specifying the second portion may include drawing the second portion in the same drawing that instantiates the first portion, adding the second portion to the same computer molding that instantiates the first portion, adding a description of dimensions of the second portion to a description of the dimensions of the first portion, adding the second portion to a prototype that includes the first portion, or the like.

Thus, the process of FIG. 1 results in the instantiation of a design of a multi-band antenna in a concrete form, with the first portion of the antenna providing operability in the first frequency band and the second portion of the antenna providing operability in the second frequency band. Moreover, because the first portion of the antenna was specified based on an existing design (process block 10), the overall process of designing the multi-band antenna may be much cheaper and much faster than a process of designing a multi-band antenna completely from scratch.

In certain examples, the first portion may be considered as having been specified "based on" an existing design when at least one feature of the first portion is directly copied from an existing design.

In certain examples, the first portion may be considered as having been specified "based on" an existing design when the first portion was specified by starting with an instantiation of the existing design (e.g., a CAD file) and making modifications to the instantiation of the existing design to arrive at the first portion.

In certain examples, the first portion may be considered as having been specified "based on" an existing design when the entity who specified the first portion had knowledge of the existing design at the time the first portion was specified, and the overall structure of the first portion is similar to that of the existing design. The overall structures may be "similar" when, for example, any differences in structural configuration between the existing design and the specified first portion do not result in significant differences in electrical properties of the antennas created from the designs, such as their frequency band, impedance, radiation pattern, and gain. A difference in the frequency bands of the two designs may be considered as not being significant when the frequency bands at least partially overlap, have respective bandwidths that differ by less than 200 MHz, and have respective central frequencies that differ by less than 200 MHz. A difference in the impedances of the two designs may be considered as not being significant when $|Z_1-Z_2|<30\Omega$, where $Z_1$ is the impedance of the antenna specified in existing design and $Z_2$ is the impedance of the antenna specified in the first portion. A difference in the maximum gains of the two designs may be considered as not being significant when $|G_1-G_2|<2$ dBi, where $G_1$ is the maximum gain of the antenna specified in existing design and $G_2$ is the maximum gain of the antenna specified in the first portion. A difference in the radiation patterns of the two designs may be considered as not being significant when $|\psi_1-\psi_2|<30°$, where $\psi_1$ is the degrees from horizon of the maximum gain of the antenna specified in existing design and $\psi_2$ is the degrees from horizon of the maximum gain of the antenna specified in the first portion.

In certain examples, the first portion may be considered as having been specified "based on" an existing design when the entity who specified the first portion referred to the existing design while specifying the first portion.

In certain examples, the aforementioned existing design may be any design of a single-band monopole antenna that has already been instantiated in a concrete form, such as in a drawing, in a CAD file, in an image, in a prototype, in a textual description, and so on. In certain examples, an existing physical antenna may itself be considered to be the aforementioned existing design.

As noted above, the existing design may describe a single-band monopole antenna that is for operating in a first frequency band. In other words, the existing design is such that, if a physical antenna were produced based on the design, the antenna would be operable in the first frequency band. In certain examples, the first frequency band is a 5 GHz frequency band. The 5 GHz frequency band may be any frequency band that overlaps any part of the range between 5 and 6 GHz. In certain examples, the 5 GHz frequency band may be the band spanning 5.725 GHz to 5.875 GHz, which is the frequency band used in certain IEEE 802.11 (i.e., WiFi) communications.

As used herein and in the appended claims, "operable" means that the structure of antenna is such that, if it were appropriately connected to a ground plane, a signal source, and/or a receiver, it would be capable of operating in the manner described. As used herein and in the appended claims, "operable" does not imply that the antenna actually is connected to a ground plane, a signal source, and/or a receiver, much less that the antenna is actually operated, but rather refers to the capability of the antenna to so operate if it were so connected. Thus, for example, reference to an antenna being "operable" in a particular frequency band means that the structure of the antenna is such that, if it were appropriately connected, it would be capable of operating in the frequency band.

As used herein and in the appended claims, an antenna is capable of operating in a frequency band if it has an acceptable level of performance thought-out the entirety of the band, such as, for example, having a voltage standing wave ratio (VSWR) that is less than 2 to 1 throughout the band.

As noted above, in process block 20 the second portion is added to the first portion as a dipole parasitic resonator that is resonant in a second frequency band. In other words, the second portion is specified such that, if a physical antenna were produced based on the design, the second portion would be resonant in the second frequency band. In certain examples, the second frequency band is a 2 GHz frequency band. The 2 GHz frequency band may be any frequency band that overlaps any part of the range between 2 and 3 GHz. In certain examples, the 2 GHz frequency band may be the band spanning 2.4 to 2.5 GHz, which is the frequency band used in certain IEEE 802.11 (i.e., WiFi) communications. As used herein and in the appended claims, the resonator is "resonant" in a frequency band if it has a voltage standing wave ratio (VSWR) that is less than 2 to 1 throughout the band.

Although process blocks 10 and 20 were described above sequentially, there is no requirement that process blocks 10 and 20 be performed sequentially. For example, in the process of designing the multi-band antenna, some parts of the second portion may be specified before some parts of the first portion have been specified, and vice-versa.

Figure 2A:
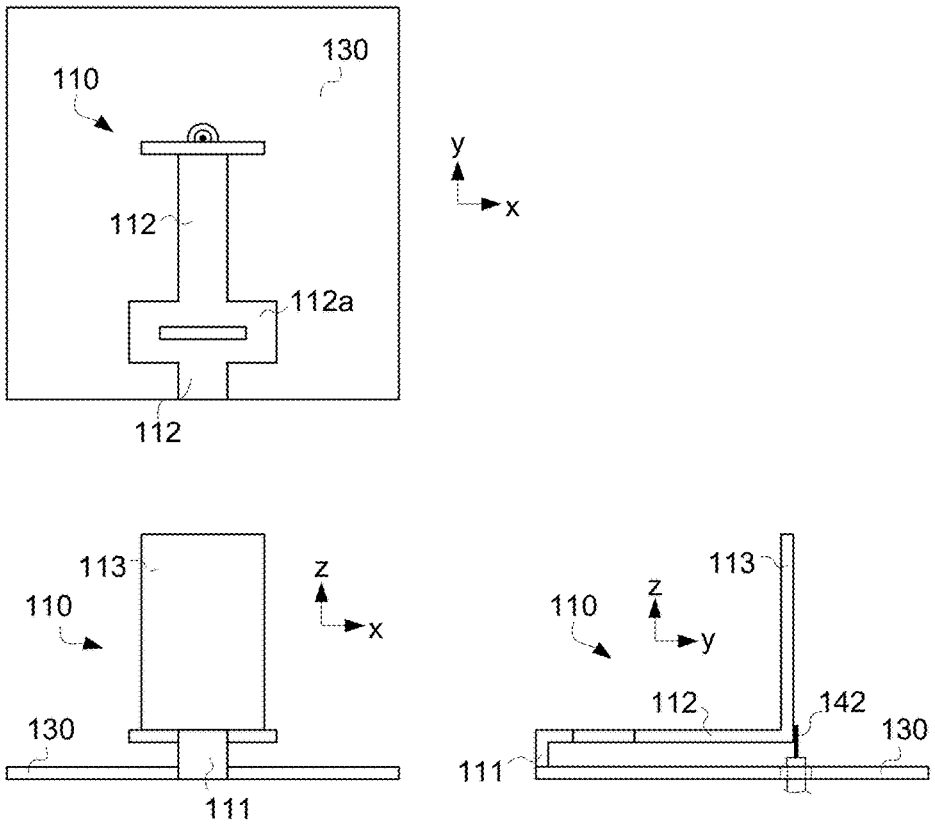
FIG. 2A is a diagram illustrating an example first portion of a multi-band antenna.

FIG. 2A illustrates an example monopole antenna 110. The first portion of the multi-band antenna that is specified in process block 10 may correspond to the monopole antenna 110. In FIG. 2A, the example monopole antenna 110 is illustrated via a multi-view orthographic projection, which includes a front elevation view (bottom left), a right elevation view (bottom right), and a plan view or top-down view (top).

The example monopole antenna 110 includes a ground plane portion 130, a first segment 111, a second segment 112, and a third segment 113.

In certain examples, the ground plane portion 130 may serve as a platform to connect the monopole antenna 110 to a ground plane when the monopole antenna 110 is installed for operation. In such a case, the ground plane portion 130 may be connected to the ground plane by any means (e.g., mechanical connectors, solder, welding, or the like). In certain other examples, the ground plane portion 130 may itself be the ground plane.

The first segment 111 is electrically connected to and extends away from the ground plane portion 130. For example, if an upper face of the ground plane portion 130 is parallel to an x-y plane (as in FIG. 2A), then the first segment 111 may extend from the ground plane portion 130 generally in a z-direction. The orientation of the first segment 111 relative to the ground plane portion 130 does not need to be precisely perpendicular to the ground plane portion 130; for example, the first segment 111 may extend in a direction that differs from the z-direction by up to 60°.

The second segment 112 is electrically connected to and extends away from the first segment 111. In particular, the second segment 112 may extend away from the first segment 111 in a first direction that is generally parallel to an upper face of the ground plane portion 130 (e.g., a y-direction in FIG. 2A). The second segment 112 may form a shunt-matching inductance of the monopole antenna 110, which serves to cancel out a reactive component of the monopole antenna 110 arising due to a capacitive component of the monopole antenna 110. The second segment 112 also may participate in obtaining a desired VSWR of the monopole antenna 110. The orientation of the second segment 112 relative to the ground plane portion 130 does not need to be precisely parallel to the ground plane portion 130; for example, the second segment 112 may extend in a direction that differs from the y-direction by up to 45°.

In certain examples, the second segment 112 may include a platform portion 112*a*, which is shown in FIG. 2A protruding in approximately an x-direction. The platform portion 112*a* may be for facilitating connection of a dipole parasitic resonator 120 (described further below) to the monopole antenna 110. In certain examples, no platform portion 112*a* is included in the second segment 112. In certain examples, the existing design upon which the first portion is based does not include the platform portion 112*a*, while the first portion that is specified based on the existing design does include the platform portion 112*a*; in other words, the first portion may be a modified version of the existing design in which the platform portion 112*a* has been added.

Figure 3:
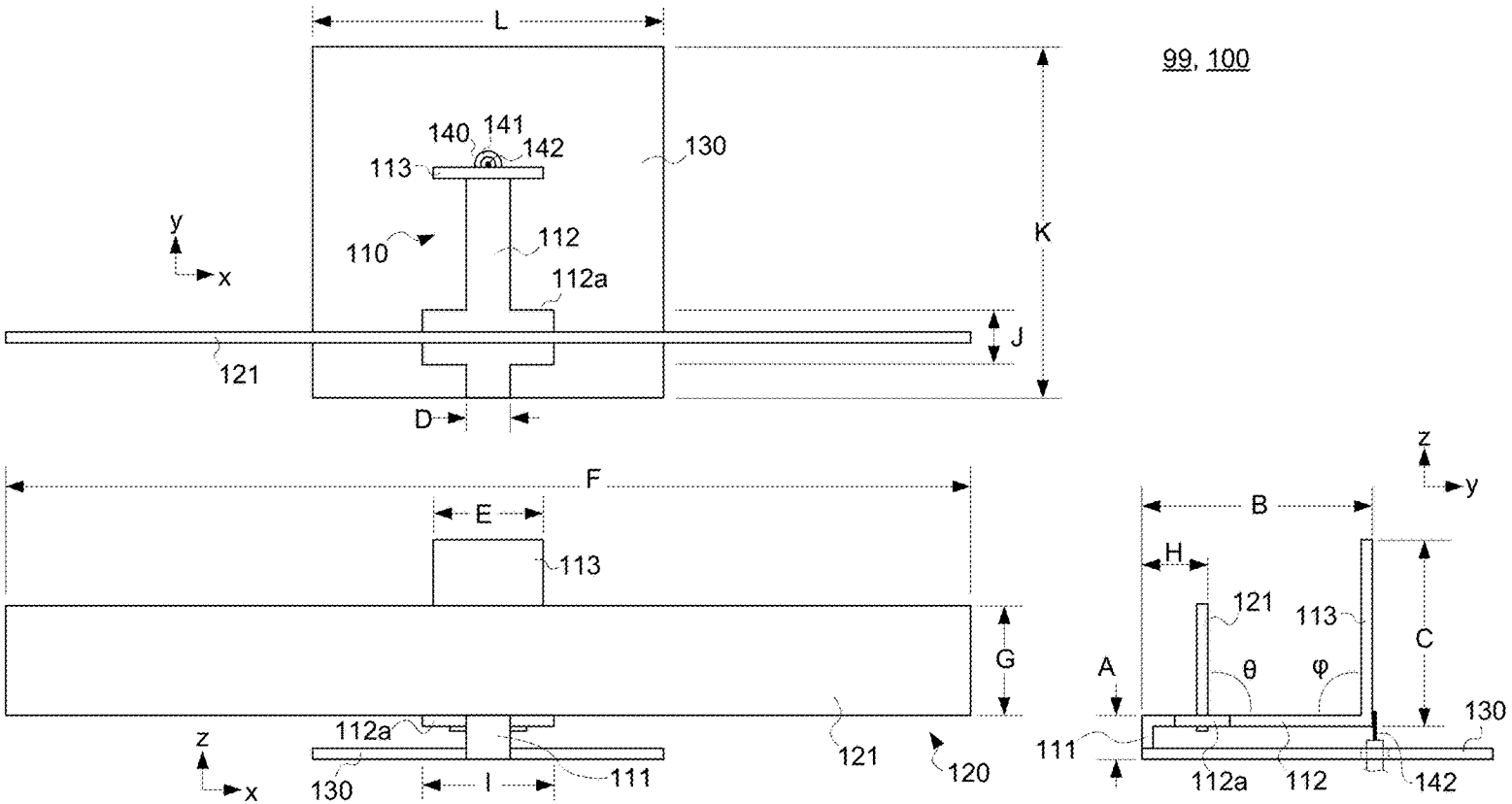
FIG. 3 is a diagram illustrating an example antenna.

The third segment 113 is electrically connected to and extends away from the second segment 112. In particular, the third segment 113 may extend away from the second segment 112 in a second direction that is generally away from the ground plane portion 130 (e.g., a z-direction in FIG. 2A). In the example of FIGS. 3 and 3, the third segment is perpendicular to the second segment 112 (i.e., $\varphi=90°$. However, the orientation of the third segment 113 relative to the second segment 112 and/or relative to ground plane portion 130 does not need to be precisely perpendicular; for example, the third segment 113 may extend in a direction that differs from the z-direction by up to 45°. Thus, in certain examples, $45°<\varphi<135°$.

The various parts of the monopole antenna 110 may be integrally formed from a same piece of material as one another; for example a single piece of sheet metal may be formed into the ground plane portion 130, the first segment 111, the second segment 112, and the third segment 113. As another example, any of the parts of the monopole antenna 110 may be formed from a separate piece of material than one of its neighboring parts, and may be connected to that neighboring part by mechanical connectors (not illustrated), solder (not illustrated), welding (not illustrated), or the like. In other words, herein and in the appended claims, a reference to one element being "connected to" another element may refer to both cases in which the elements are (or were) separate pieces of material that are now physically and electrically connected to each other (by whatever means) and cases in which the elements are integral parts of the same piece of material.

FIG. 2A also illustrates a signal line 142, which may be connected to the third segment 113. The signal line 142 is illustrated to provide context, but in certain examples the monopole antenna 110 does not necessarily include the signal line 142. For example, the signal line 142 may be connected to the monopole antenna 110 when the monopole antenna 110 is installed for operation in a device. In other examples, the monopole antenna 110 may include the input signal line 142. The signal line 142 may extend through a hole 140 in the ground plane portion 130 in such a manner that the signal line 142 is not in direct electrical contact with the ground plane portion 130. For example, a non-conductive housing 141 may keep the signal line 142 from directly electrically contacting the ground plane portion 130 while maintaining a characteristic impedance geometry (such as a 50 Ohm characteristic impedance geometry). When the antenna is installed for operation, a transmission signal may be supplied from a transmission device to the antenna via the signal line 142 and a reception signal may be supplied from the antenna to a reception device via the signal line 142.

Figure 2B:
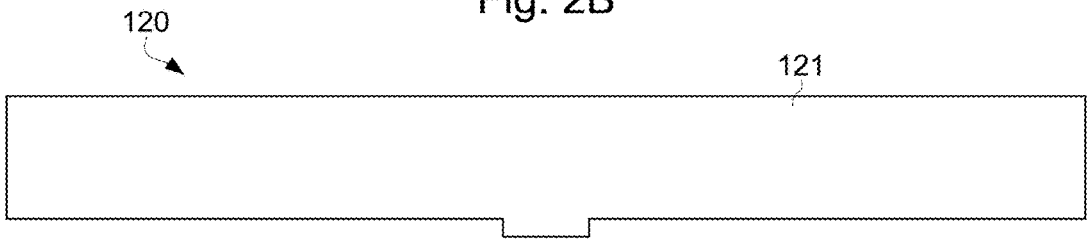
FIG. 2B is a diagram illustrating an example second portion of an antenna.

FIG. 2B illustrates an example dipole parasitic resonator 120. The second portion of the multi-band antenna that is specified in process block 20 may correspond to the dipole parasitic resonator 120.

The example dipole parasitic resonator 120 may include a fourth segment 121. The fourth segment 121 may be shaped so as to be parasitically resonant in a second frequency band when added to the monopole antenna 110. For example, the fourth segment may have an elongated shape (i.e., a shape with an aspect ratio X:Y, where X>Y), which is configured to parasitically resonate in the second frequency band when added to the monopole antenna 110. In certain examples, a shape of the fourth segment 121 may be set such that it does not excessively distort the radiation pattern of the monopole antenna 110. In particular, the taller that the fourth segment 121 is (e.g., the dimension G), particularly near the center of the fourth segment 121, the further from the third segment 113 the fourth segment 121 should be placed (e.g., the dimension B—H) in order to avoid blocking too much radiation from the third segment 113. However, making the fourth segment 121 too short or placing the dipole parasitic resonator 120 too far from the third segment 113 may make it difficult for the dipole parasitic resonator 120 to resonate in the second frequency band. Thus, an optimal height (G) and distance (B—H) may be found for a desired application of the antenna 100 experimentally by measuring VSWR of the dipole parasitic resonator 120 and radiation pattern of the first segment 110 at various values of G and B—H. Various example values of these parameters are described below.

In the example shown in FIG. 2B, the dipole parasitic resonator 120 has a small protrusion on one side near a longitudinal center of the fourth segment 121, which may be for facilitating connecting the dipole parasitic resonator 120 to the monopole antenna 110. For example, the protrusion may fit into a slot in a platform portion 112*a* of the monopole antenna 110. However, the dipole parasitic resonator 120 may omit the protrusion.

Figure 4:
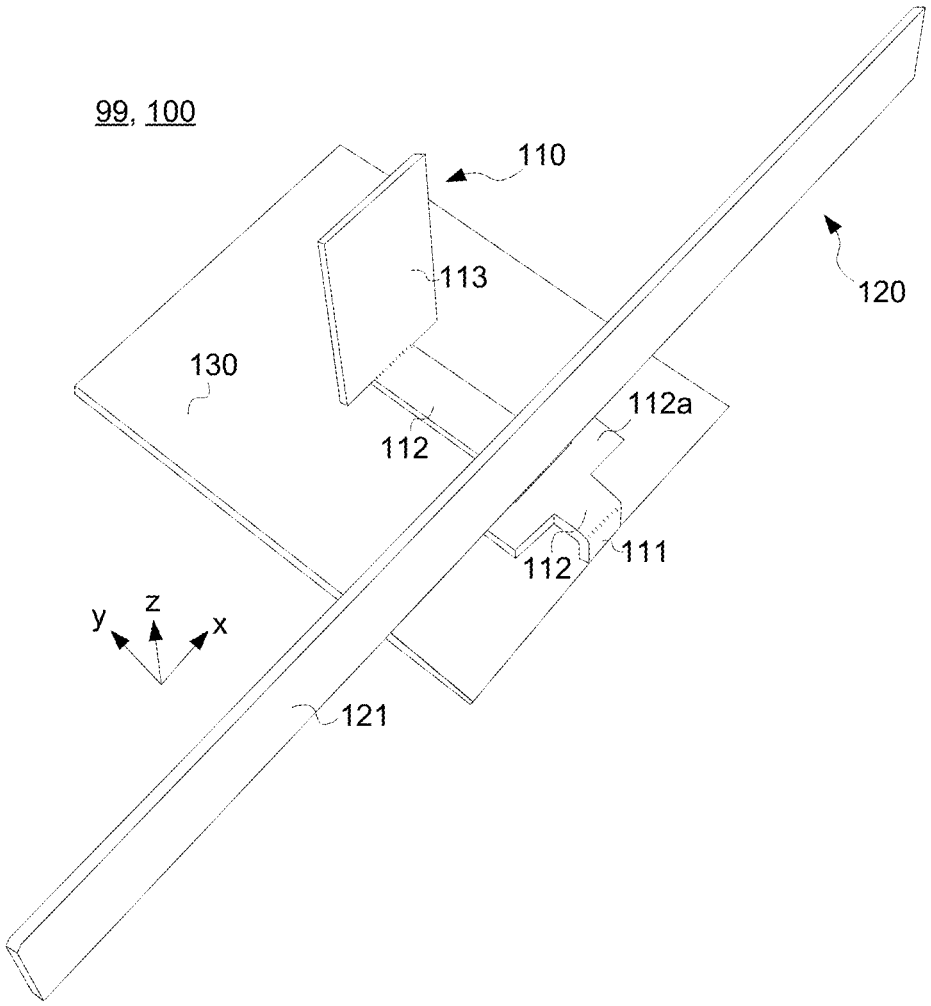
FIG. 4 is a diagram illustrating an example antenna.

FIGS. 3 and 4 conceptually illustrate an example multi-band antenna 100. The illustration of the example multi-band antenna 100 in FIGS. 3 and 4 may also be considered to be an example design 99 resulting from the process of FIG. 1. In other words, the example multi-band antenna 100 is conceptually illustrated by showing an example design 99 that corresponds to the example multi-band antenna 100. In FIG. 3, the example design 99/multi-band antenna 100 is illustrated via a multi-view orthographic projection, which includes a front elevation view (bottom left), a right elevation view (bottom right), and a plan view or top-down view (top). In FIG. 4 the example design 99/multi-band antenna 100 is illustrated by a perspective view. Hereinafter FIGS. 3 and 4 will be described with reference to the multi-band antenna 100 for ease of description, but it should be understood that the description applies similarly to the design 99.

The example multi-band antenna 100 includes the example dipole parasitic resonator 120 described above added to the example monopole antenna 110 described above. In particular, the fourth segment 121 of the dipole parasitic resonator 120 is electrically connected to the second segment 112 of the monopole antenna 110 at approximately a longitudinal center of the dipole parasitic resonator 120, such that the second segment 112 extends away from the second segment 112 in two opposite and generally parallel directions (e.g., in a (+x)-direction and a (−x)-direction). In certain examples, the fourth segment 121 may be oriented so as to face the third segment 113. For example, in FIGS. 3 and 3 the fourth segment 122 is substantially perpendicular to the second segment 112 and substantially parallel to the third segment 113 (i.e., $\theta=90°$). However, the orientation of the fourth segment 121 relative to the second segment 112 and/or the ground plane portion 130 does not need to be precisely perpendicular and the orientation relative to the third segment 113 does not need to be precisely parallel; for example, the third segment 113 may extend in a direction that differs from the z-direction by up to 90°. Thus, in certain examples, $45°<\theta<180°$.

The fourth segment 121 may be connected to the second segment 112 by any technique, such as, for example, mechanical fasteners (not illustrated), solder (not illustrated), welding (not illustrated), or the like. For example, the dipole parasitic resonator 120 may include a protrusion and the second segment may include a slot in a platform portion 112*a*, and the fourth segment 121 may be connected to the second segment 112 by inserting the protrusion into the slot and soldering at a point of contact.

In certain examples, the various portions of the multi-band antenna 100 may have dimensions as labeled in FIG. 3, with values being set as follows (all dimensions in mm):

| | | | | | |
|---|---|---|---|---|---|
| A = 2.1 | B = 10.1 | C = 11.0 | D = 2.0 | E = 5.0 | F = 47.46 |
| G = 5.0 | H = 3.2 | I = 6.0 | J = 2.5 | K = 19 | L = 15 |

In certain examples, the values of the dimensions C and F (i.e., the respective lengths of the third segment 113 and the fourth segment 121) are set based on the first and second frequency bands that the antenna 100 is to be operable in. For example, the dimension C may be set such that $C'=1/4*\lambda_1$, where $\lambda_1$ is a wavelength corresponding to a central frequency of the first frequency band and C' is the electrical length of the third segment 113 when the physical length of the third segment 113 is C. As another example, and the dimension F may be set such that $F'=1/2*\lambda_2$, where $\lambda_2$ is a wavelength corresponding to a central frequency of the second frequency band and F' is the electrical length of the fourth segment 121 when the physical length of the fourth segment 121 is F.

In certain examples, the multiband antenna 100 may have a maximum height above the ground plane of less than 20 mm. In certain examples, the multiband antenna 100 may have a maximum height above the ground plane of less than 15 mm. In certain examples, the multiband antenna 100 may have a maximum height above the ground plane of less than 12 mm. In certain examples, the multiband antenna 100 may have a maximum height above the ground plane of less than 11 mm. In certain examples, the multiband antenna 100 may have an impedance of 50 Ohms. In certain examples the multiband antenna 100 may have a maximum gain of 5 dBi. In certain examples, the multiband antenna 100 may have a radiation pattern that is omnidirectional in azimuth with a maximum gain at 30 from horizon.

In certain examples, the multiband antenna 100 may be operable in a first frequency band and a second frequency band, which is different from the first frequency band. In certain examples, the first frequency band may be a 5 GHz frequency band and the second frequency band may be a 2 GHz frequency band. In certain examples, the 2 GHz frequency band may be any frequency band that overlaps any part of the range between 2 and 3 GHz, while the 5 GHz frequency band may be any frequency band that overlaps any part of the range between 5 and 6 GHz. In certain examples, the 2 GHz frequency band may be the band spanning 2.4 to 2.5 GHz, and the 5 GHz frequency band may be the band spanning 5.725 GHz to 5.875 GHz, which are frequency bands used in certain IEEE 802.11 (i.e., WiFi) communications.

The first frequency band and the second frequency band do not necessarily need to be separated, and in certain examples they may be adjacent or contiguous. In certain examples, the first frequency band and the second frequency band may overlap. Thus, the addition of the dipole parasitic resonator 120 may serve either to add a new distinct band to an existing antenna design or to expand the existing bandwidth of the existing antenna design. Thus, references herein to a "multi-band" antenna should be understood to include both antennas with two distinct bands as well as antennas with a single contiguous band whose bandwidth has been expanded by the addition of the dipole parasitic resonator 120.

Although specific examples of the monopole antenna 110 and the dipole parasitic resonator 120 are shown in FIGS. 2-4, certain examples of the multi-band antenna 100 may have monopole antennas 110 and/or dipole parasitic resonators 120 that differ from the specific examples shown in FIGS. 2-4 without significantly altering the electrical properties of the multi-band antenna 100. For example, FIGS. 5-10 illustrate various modifications that could be made to the monopole antenna 110 and the dipole parasitic resonator 120, and the multi-band antenna 100 could include any combination of these variations.

Figure 5:
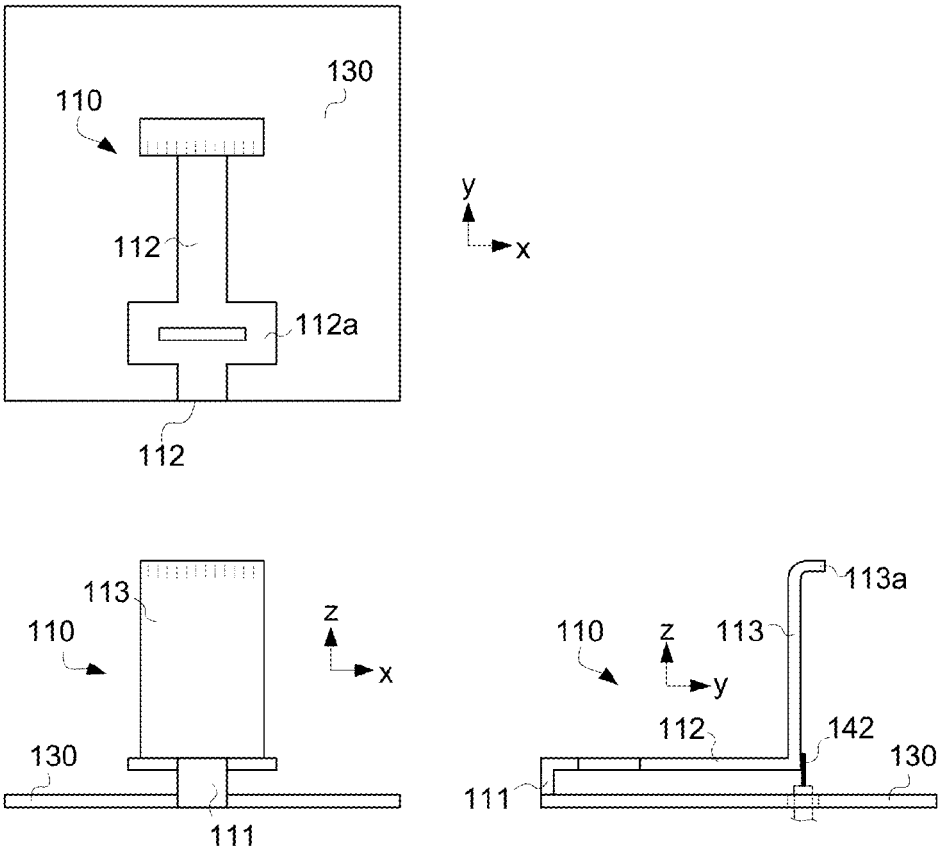
FIG. 5 is a diagram illustrating an example first portion of an antenna.

FIG. 5 illustrates a modification to the monopole antenna 110 in which the third segment 113 has been bent near a top thereof, such that an end portion 113*a* of the third segment 113 faces the ground plane portion 130. This may reduce an overall height of the multi-band antenna 100. In certain examples, bending the third segment 113 may allow for the antenna 100 to have a maximum height that is less than 11 mm while still operating in the 5 GHz frequency band. In certain examples, the bent end portion 113*a* may extend from the vertical portion of the third segment 113 up to approximately half the length of the third segment (i.e., C/2) without significantly changing the electrical properties of the multi-band antenna 100.

Figure 6:
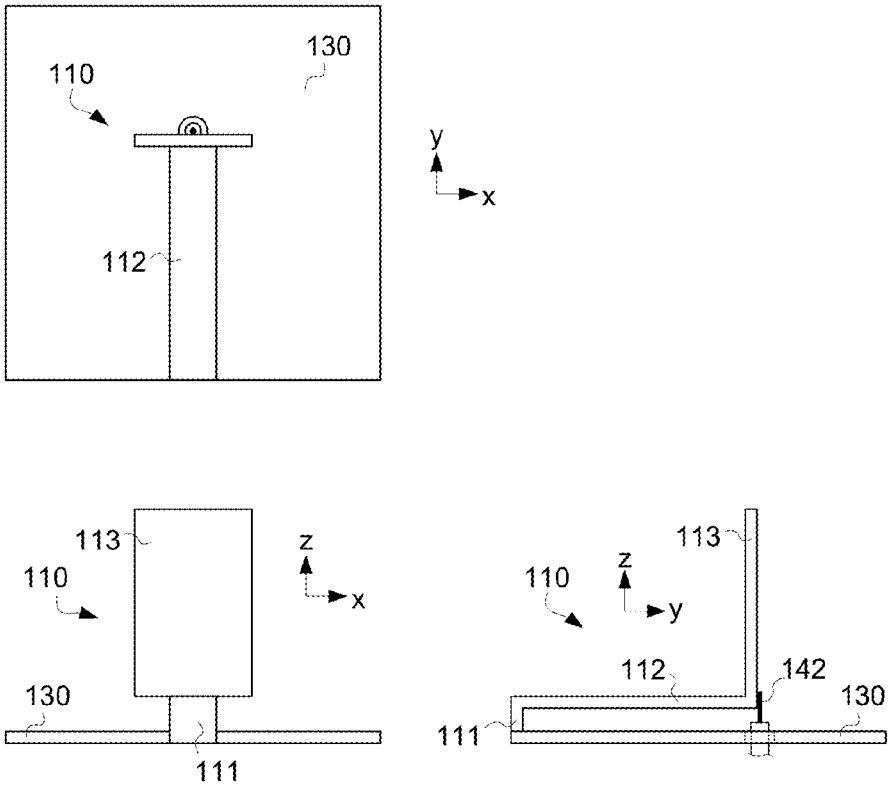
FIG. 6 is a diagram illustrating an example first portion of an antenna.

FIG. 6 illustrates a modification to the monopole antenna 110 in which the second segment 112 does not include the platform portion 112*a*.

Figure 7:
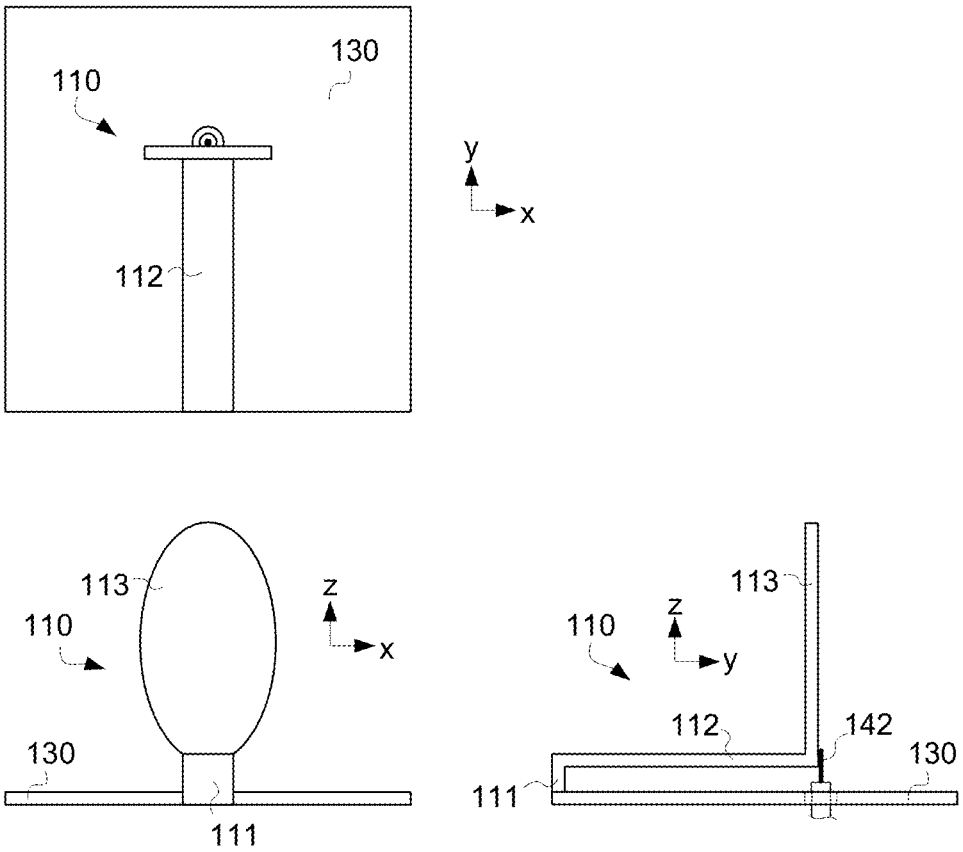
FIG. 7 is a diagram illustrating an example first portion of antenna.
Figure 8:
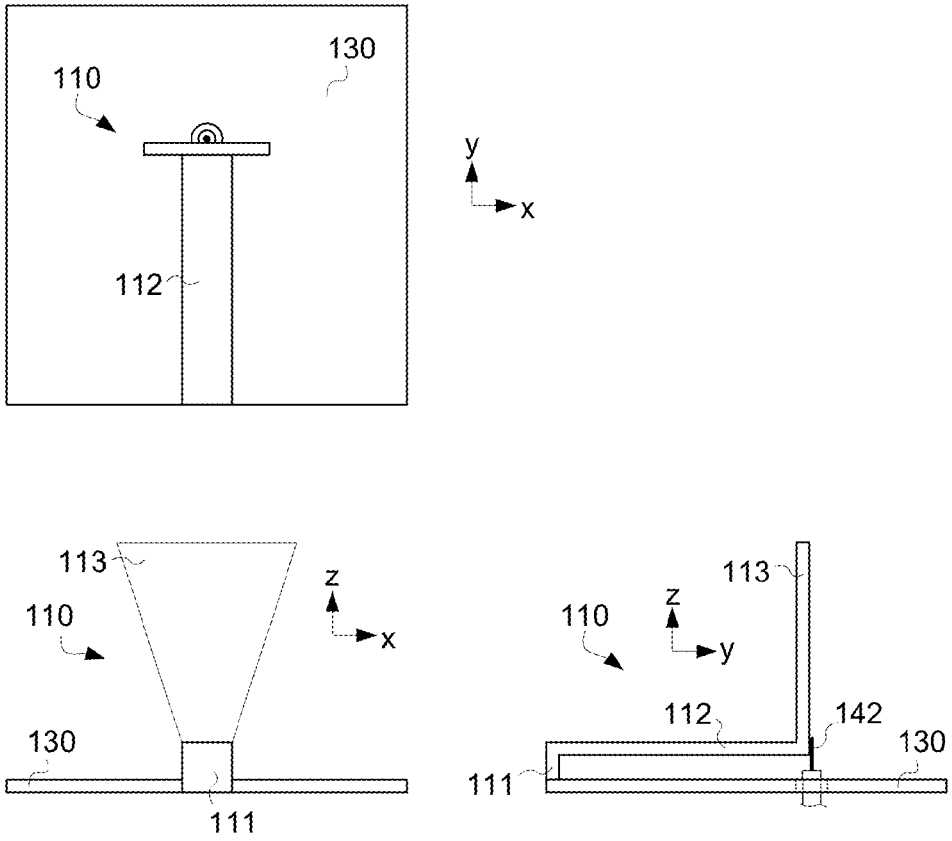
FIG. 8 is a diagram illustrating an example first portion of an antenna.

FIG. 7 illustrates a modification to the monopole antenna 110 in which the third segment 111 has an approximately elliptical profile rather than an approximately rectangular profile. FIG. 8 illustrates a modification to the monopole antenna 110 in which the third segment 111 has an approximately trapezoidal profile rather than an approximately rectangular profile.

Figure 9:
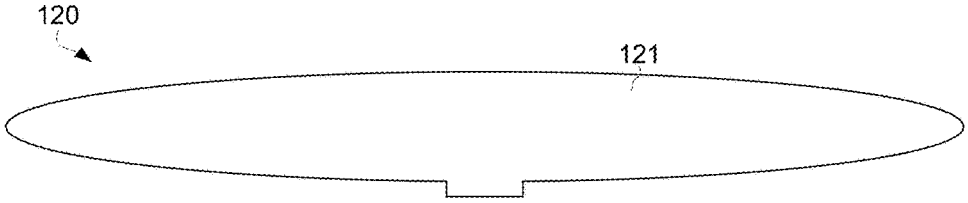
FIG. 9 is a diagram illustrating an example second portion of an antenna.
Figure 10:
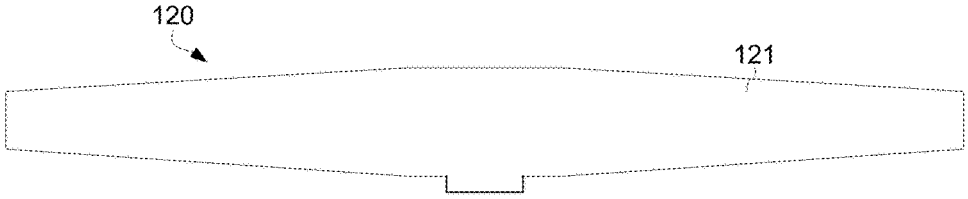
FIG. 10 is a diagram illustrating an example second portion of an antenna.
Figure 11:
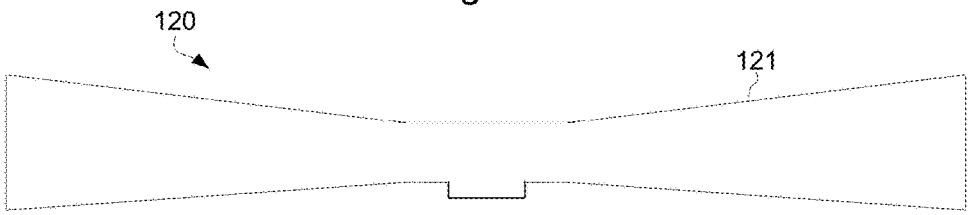
FIG. 11 is a diagram illustrating an example second portion of an antenna

FIG. 9 illustrates a modification to the dipole parasitic resonator 120 in which the fourth segment 121 has an approximately elliptical profile rather than an approximately rectangular profile. FIG. 10 illustrates a modification to the dipole parasitic resonator 120 in which the fourth segment 121 has a profile that tapers towards the distal ends rather than an approximately rectangular profile. FIG. 11 illustrates a modification to the dipole parasitic resonator 120 in which the fourth segment 121 has a profile that tapers towards the center (e.g., a bow-tie shape) rather than an approximately rectangular profile.

Figure 12:
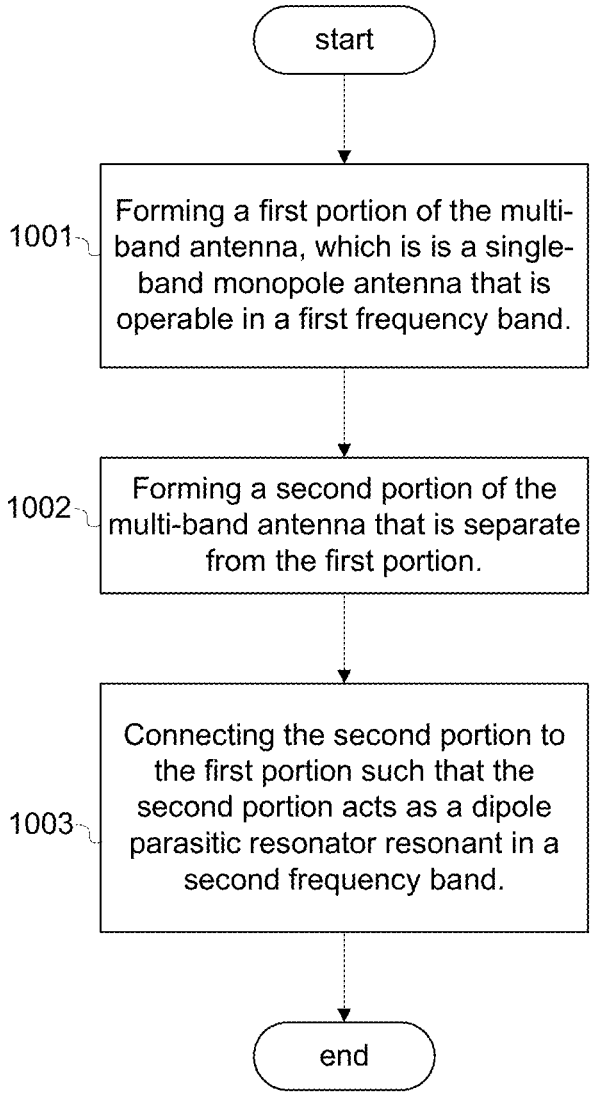
FIG. 12 is a process flow diagram illustrating an example process.

FIG. 12 illustrates an example method of manufacturing a multi-band antenna.

In process block 1001, a first portion of the multi-band antenna is formed. The first portion of the multi-band antenna may be such that, upon being formed, it is a single-band monopole antenna that is operable in a first frequency band. For example, the first portion of the multi-band antenna may be formed based on the first portion in the design 99 described above, and may correspond to the monopole antenna 110 described above. For example, the first portion of the multi-band antenna may be formed by patterning a piece of sheet metal into a profile shape corresponding to the first portion, and bending the patterned sheet metal into the configuration illustrated in FIG. 2A.

The first portion of the multi-band antenna may be formed such that it includes a first segment connected to a ground plane and extending away from the ground plane, a second segment connected to the first segment and extending therefrom in a first direction that is approximately parallel to the ground plane, and a third segment connected to the second segment and extending therefrom in a second direction approximately perpendicular to the ground plane, a signal source being connected to the third segment.

In certain examples, the first frequency band may be a 5 GHz frequency band. In certain examples, the 5 GHz frequency band may be any frequency band that overlaps any part of the range between 5 and 6 GHz. In certain examples, the 5 GHz frequency band may be the band spanning 5.725 to 5.875 GHz.

In process block 1002, a second portion of the multi-band antenna that is separate from the first portion is formed. For example, the second portion of the multi-band antenna may be formed based on the second portion in the design 99 described above, and may correspond to the dipole parasitic resonator 120 described above. For example, the first portion of the multi-band antenna may be formed by patterning a piece of sheet metal into a profile shape of the second portion, such as is illustrated in FIG. 2B.

In process block 1003, the second portion is electrically connected to the first portion in such a manner that the second portion acts as a dipole parasitic resonator resonant in a second frequency band. For example, the second portion may be connected to the first portion in the manner illustrated in FIGS. 3-4. For example, the second portion may be connected to a shunt-matching inductance of the first portion at roughly a longitudinal center of the second portion. The connection may be, for example, by mechanical fasteners, soldering, welding, or the like. For example, the second portion may include a protrusion and the first portion may include a slot in a connection area, and the second portion may be connected to the first portion by inserting the protrusion into the slot and soldering at a point of contact.

The second portion may be connected to a second segment of the first portion at approximately a longitudinal center of the second portion so as to face a third segment of the first portion and to have a longitudinal axis oriented along a direction that is approximately parallel to the ground plane and approximately perpendicular to a direction in which the second segment extends.

In certain examples, the second frequency band may be a 2 GHz frequency band. In certain examples, the 2 GHz frequency band may be any frequency band that overlaps any part of the range between 2 and 3 GHz. In certain examples, the 2 GHz frequency band may be the band spanning 2.4 GHz to 2.5 GHz.

At various places throughout the disclosure, references are made to items being "approximately parallel" or "approximately perpendicular" to other times. It should be understood that these references are meant to indicate a general direction or orientation, which may differ from exactly parallel or exactly perpendicular. Unless otherwise stated, an item may be "approximately parallel" or "approximately perpendicular" to another item when it is within ±45° of being exactly parallel or exactly perpendicular.

The foregoing describes example antennas, example processes for designing antennas, and example processes for manufacturing antennas. While the above disclosure has been shown and described with reference to the foregoing examples, it should be understood that other forms, details, and implementations may be made without departing from the spirit and scope of this disclosure.

What is claimed is:

1. A multi-band antenna comprising:

a first portion that corresponds to a monopole antenna operable in a first frequency band, the first portion comprising:

a first segment connected to a ground plane portion and extending away from the ground plane portion, a second segment connected to the first segment and extending away therefrom in a first direction that is approximately parallel to the ground plane portion, and a third segment connected to the second segment and extending away therefrom in a second direction that is away from the ground plane portion, a signal source being connected to the third segment; and a second portion connected to the first portion as a dipole parasitic resonator that is resonant in a second frequency band, the second portion comprising a fourth segment that:

is connected to the second segment at approximately a longitudinal center of the fourth segment, faces the third segment, and has a longitudinal axis oriented along a third direction that is approximately perpendicular to the first direction.

2. The multi-band antenna of claim 1, wherein a maximum height of the multi-band antenna above the ground plane is less than or equal to 11 mm.

3. The multi-band antenna of claim 1, wherein a VSWR of the multi-band antenna is less than 2 to 1 throughout the first and second frequency bands.

4. The multi-band antenna of claim 1, wherein the first frequency band includes a 5 GHz frequency band, and the second frequency band includes a 2 GHz frequency band.

5. The multi-band antenna of claim 1, wherein the second segment is a shunt matching inductor that provides a parallel inductance to cancel a shunt capacitance realized by the first portion.

6. A method of forming a specification of a multi-band antenna, comprising:

specifying a first portion of the multi-band antenna in a tangible medium, the first portion corresponding to an existing design of a single-band monopole antenna for operating in a first frequency band, the existing design comprising:

a first segment connected to a ground plane portion and extending away from the ground plane portion, a second segment connected to the first segment and extending away therefrom in a first direction that is approximately parallel to the ground plane portion, and a third segment connected to the second segment and extending away therefrom in a second direction that is away from the ground plane portion, a signal source being connected to the third segment; and specifying in the tangible medium a second portion of the multi-band antenna that is added to the first portion, the second portion comprising a fourth segment that acts as a dipole parasitic resonator that is resonant in a second frequency band and is connected to the second segment of the first portion.

7. The method of claim 6, wherein a maximum height of the multi-band antenna above a ground plane is less than or equal to 11 mm.

8. The method of claim 6, wherein the fourth segment:

is connected to the second segment at approximately a longitudinal center of the fourth segment, faces the third segment, and has a longitudinal axis oriented along a third direction that is approximately perpendicular to the first direction.

9. The method of claim 6, wherein specifying the second portion of the multi-band antenna includes specifying that a geometry of the fourth segment and a distance between the fourth segment and the third segment are such that a VSWR of the multi-band antenna is less than 2 to 1 throughout the first and second frequency bands and a radiation pattern of the multi-band antenna is not significantly different from a radiation pattern of an antenna comprising the first portion without the second portion.

10. The method of claim 6, wherein the first frequency band includes a 5 GHz frequency band and the second frequency band includes a 2 GHz frequency band.

11. A method of manufacturing a multi-band antenna, comprising:

forming a first portion of the multi-band antenna that, upon being formed, is a single-band monopole antenna that is operable in a first frequency band, the first portion including:

a first segment connected to a ground plane portion and extending away from the ground plane portion, a second segment connected to the first segment and extending away therefrom in a first direction that is approximately parallel to the ground plane portion, and a third segment connected to the second segment and extending away therefrom in a second direction that is away from the ground plane portion, a signal source being connected to the third segment;

forming a second portion of the multi-band antenna that is initially separate from the first portion and includes a fourth segment; and connecting the fourth segment to the second segment such that the fourth segment acts as a dipole parasitic resonator that is resonant in a second frequency band.

12. The method of claim 11, wherein a maximum height of the multi-band antenna above the ground plane is less than or equal to 11 mm.

13. The method of claim 11, wherein connecting the fourth segment to the second segment includes connecting the fourth segment to the second segment at approximately a longitudinal center of the fourth segment such that the fourth segment:

faces the third segment, and has a longitudinal axis oriented along a third direction that is approximately perpendicular to the first direction.

14. The method of claim 11, wherein, upon the fourth segment being connected to the second segment, a geometry of the fourth segment and a distance between the fourth segment and the third segment are such that a VSWR of the multi-band antenna is less than 2 to 1 throughout the first and second frequency bands and a radiation pattern of the multi-band antenna is not significantly different from a radiation pattern of an antenna comprising the first portion without the second portion.

15. The method of claim 11, wherein the first frequency band includes a 5 GHz frequency band and the second frequency band includes a 2 GHz frequency band.

* * * * *